US005092315A

United States Patent [19]

Bennett et al.

[11] Patent Number: 5,092,315

[45] Date of Patent: Mar. 3, 1992

[54] POWER-DRIVEN MASSAGER

[76] Inventors: Daniel L. Bennett, 23005 Great River Rd., LeClaire, Iowa 52753; Edward D. Hardin, 2411 Howell St., Davenport, Iowa 52803

[21] Appl. No.: 539,261

[22] Filed: Jun. 18, 1990

[51] Int. Cl.[5] ..... A61H 1/00

[52] U.S. Cl. ..... 128/32; 128/33; 128/48; 128/49; 128/51; 128/52

[58] Field of Search ..... 366/108, 110, 111, 209, 366/112; 128/32, 33, 35, 41, 44, 48, 49, 51, 52

[56] References Cited

U.S. PATENT DOCUMENTS

| | | | |
|---|---|---|---|
| 1,276,526 | 8/1918 | Hardy et al. | 128/52 |
| 3,298,363 | 1/1967 | Parkin | 128/52 |
| 3,656,190 | 4/1972 | Regan et al. | 128/33 X |
| 4,085,738 | 3/1978 | Kodera | 128/52 X |
| 4,202,326 | 5/1980 | Van Gerpen | 128/33 |
| 4,469,093 | 9/1984 | Chaplar . | |
| 4,633,858 | 1/1987 | Rutsch et al. . | |
| 4,999,861 | 3/1991 | Huang | 128/33 X |

*Primary Examiner*—Mickey Yu
*Assistant Examiner*—Brian E. Hanlon
*Attorney, Agent, or Firm*—Henderson & Sturm

[57] ABSTRACT

The disclosed massager comprises a frame at the top portion of which are a plurality of beaters or massaging elements arranged as side-by-side mirror-image systems driven by parallel camshafts, and the beaters are controlled through combination motions by guide members, one for each system, by which the beaters are guided via lost-motion means on the guide members. A third camshaft centrally between the beater-drive camshafts functions to reciprocate the guide members to further augment the motions of the beaters. The cams on each beater camshaft are strategically timed so that each beater moves in a phase different from its neighbors. The beater camshafts are driven at a speed faster than that of the guide member camshaft.

20 Claims, 4 Drawing Sheets

Fig. 1
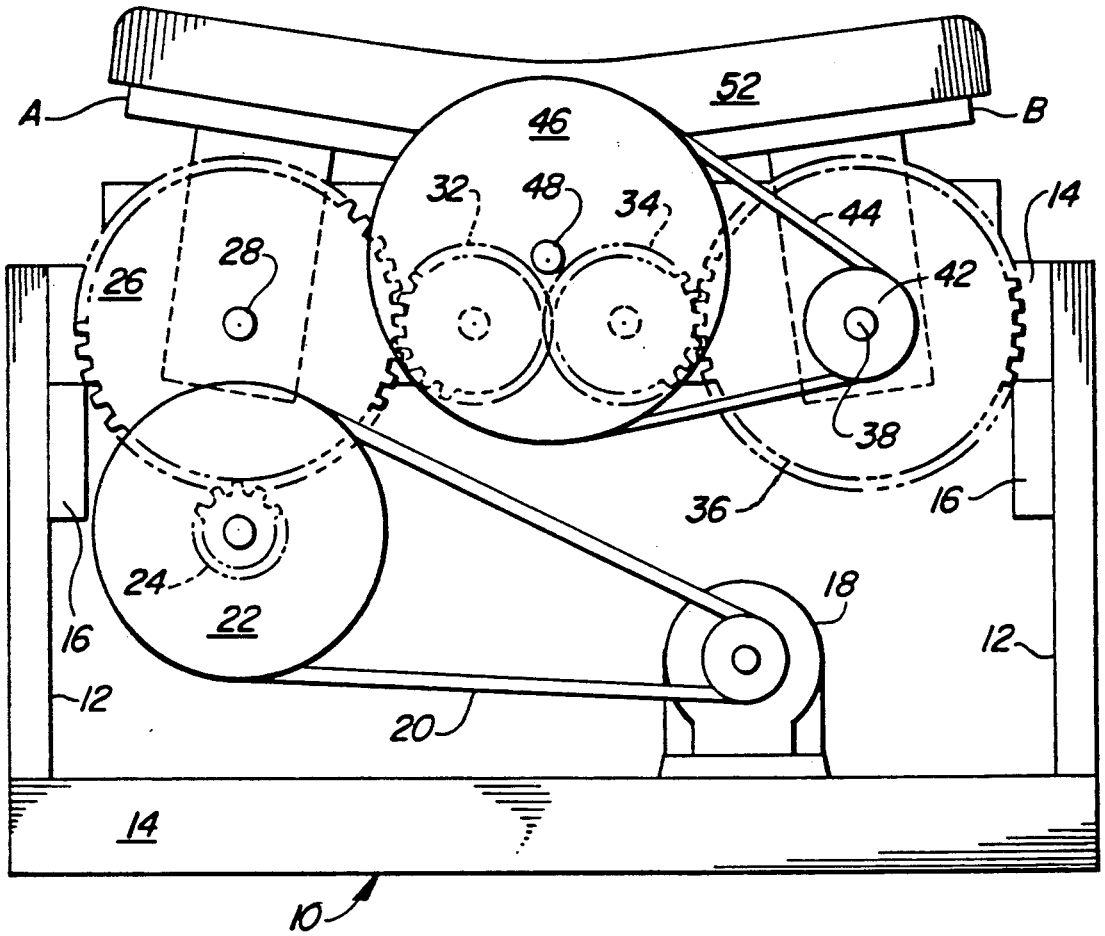
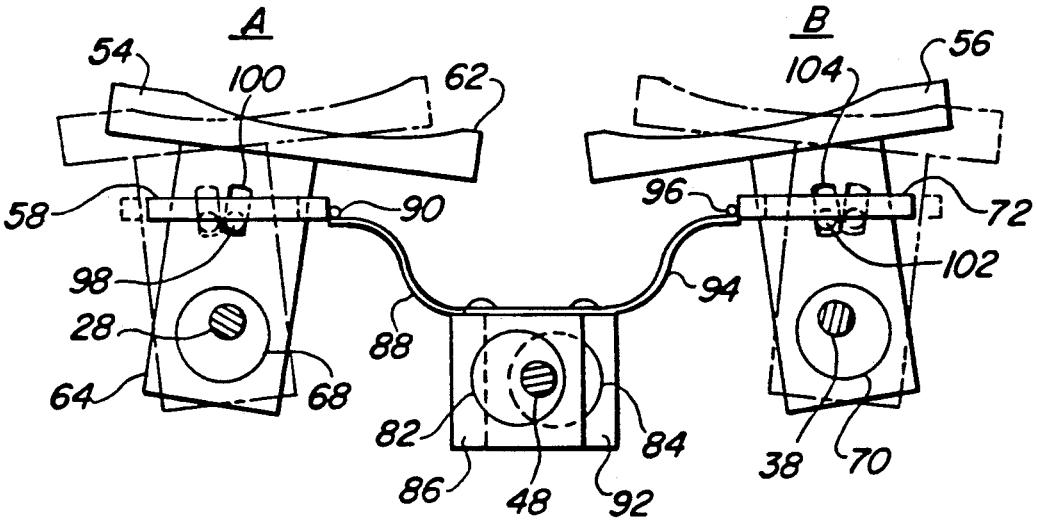
Fig. 3

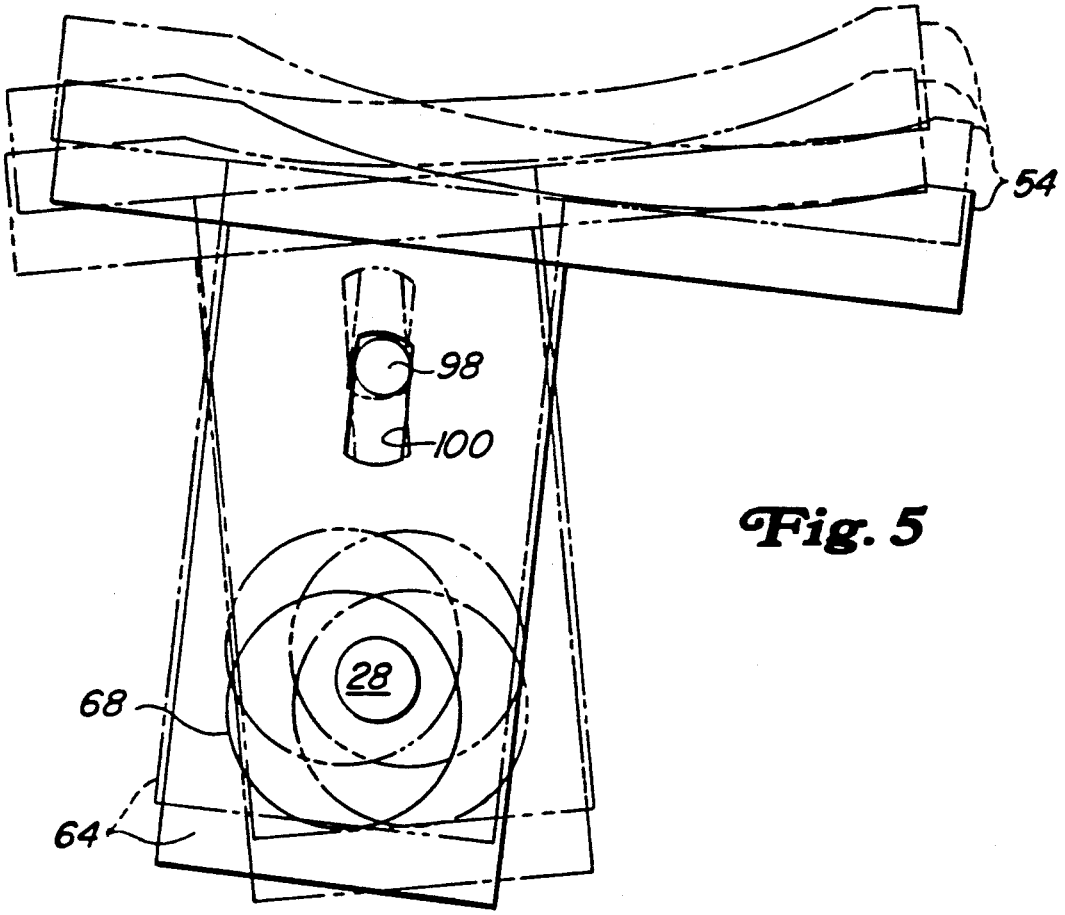
Fig. 5
Fig. 6
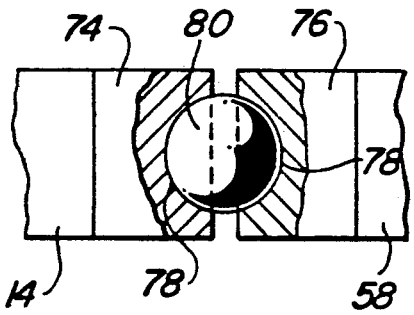

POWER-DRIVEN MASSAGER

BACKGROUND AND SUMMARY OF THE INVENTION

The prior art is replete with mechanical massagers, the basic purpose of which is generally to duplicate the massaging effect of the fingers of human attendants. Also, the benefits of massage are well known and need not be elaborated upon here. Suffice it to say that prior massaging apparatus suffers from various short-comings, such as high-cost, failure of the massaging elements to perform efficiently and with maximum health benefits, complicated mechanisms and relative freedom from requirements of maintenance, adjustment, etc.

According to the present invention, these disadvantages are eliminated and a highly efficient massager is provided, embodying simple drive mechanism imparting to the beaters or massaging elements motions that more closely approximate or reproduce the motion of a masseur's hands in performing the "Palm Edge Hammer" technique. The system may be used at infinitely-variable speeds so as to produce the desired massage intensity. The arrangement of beaters, camshafts and guide members combines tipping motions of the beaters with circular motion thereof to generate a constantly roving action.

The foregoing and other significant features of the invention will become apparent to those versed in the art as a preferred embodiment of the invention is described in detail in connection with the accompanying drawings.

DESCRIPTION OF THE DRAWINGS

FIG. 1 is an end elevation of the apparatus.

FIG. 3 is an end elevation of the components of the endmost beaters, guide members and camshafts, broken lines illustrating some of the basic motions of the parts.

FIG. 5 illustrates part of the motion of a beater.

FIG. 6 is an enlarged partial section showing how the guide member is mounted relative to the frame.

DETAILED DESCRIPTION OF A PREFERRED EMBODIMENT OF THE INVENTION

Figures 4, 7:
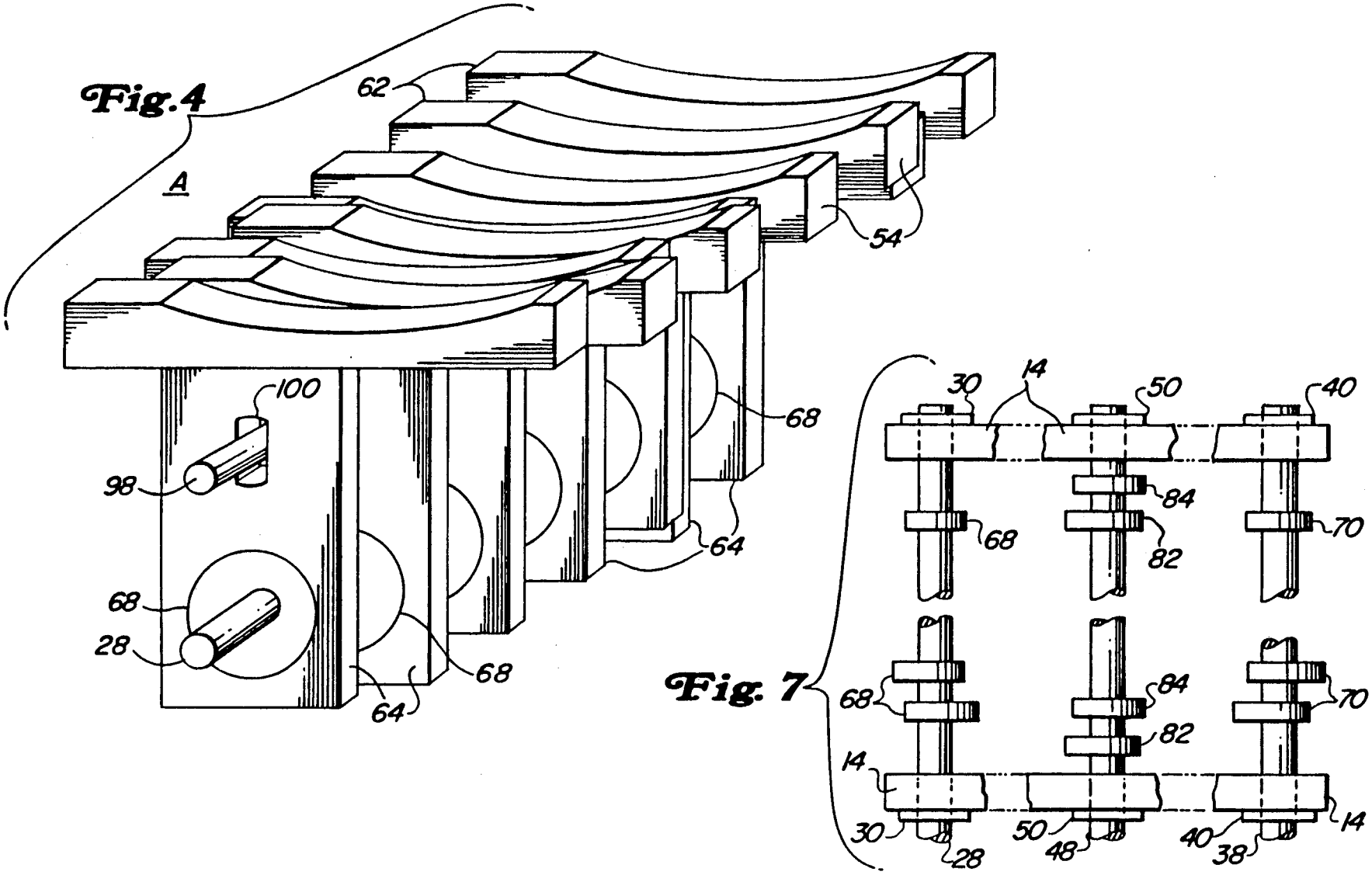
FIG. 4 is an enlarged perspective of a series of beaters as representative of those in both systems.
FIG. 7 is a partial elevation showing the mounting of the three camshafts.

Reference is had first to FIG. 1 as illustrating a typical frame 10 of rectangular construction, having opposite end posts 12, end rails 14 and longitudinal rails 16. The frame is elongated and the ends are substantial duplicates of each other. The frame carries at one end a suitable drive means, typical of which could be variable-speed electric motor 18 belted at 20 to a sheave 22 that is fixed to a spur gear 24 that in turn meshes with and drives a larger gear 26 keyed or otherwise affixed to a longitudinal shaft 28 journalled on the frame by bearings 30 (FIG. 7). The gear 26 meshes with a smaller gear 32 that is in mesh with a like-diametered gear 34 that meshes with a large gear 36 fixed to a longitudinal shaft 38 which is of course parallel to the shaft 28 and is journalled in the frame by bearings 40 (FIG. 7). The shaft 38 carries a sheave 42 that is belted at 44 to a sheave 46 keyed to a longitudinal shaft 48. The shaft 48 is located midway between the shafts 28 and 38 and is journalled at 50 as seen in FIG. 7. The frame, drive means and the "geographical" dispositions of the parts are representative and therefore the description should be taken as explanatory rather than limiting. By way of example only, representative gear and sheave diameters could be as follows: motor sheave 2.25"; sheave 22=8"; gear 24=2"; gears 26 and 36=9"; gears 32 and 34=4"; sheave 42=3"; sheave 46=10".

As a general proposition, the apparatus comprises a pair of systems or arrangements A and B disposed symmetrically at opposite sides of the longitudinal center line of the frame (FIGS. 1 and 3). In FIG. 1, a typical cushion 52 is shown as superimposed over both systems. The system A includes a plurality of beaters 54 spaced apart lengthwise of the frame and a like plurality of beaters 56 is included in the system B. As an alternative to the use of the cushion 52, the tops of the beaters may be individually padded, both examples being a matter of choice and not operative to limit the scope of the invention. A basic part of the A system is a guide means for guiding the beaters during their motion. In the present illustration, the guide means is shown as a longitudinal guide member or board 58 that runs lengthwise of the frame and that has a plurality of laterally elongated slots 60 through which the beaters respectively extend, the beaters thus having upper ends 62 above the board and lower ends 64 below the board. The lower end of each beater has a circular bearing opening 66 which is journalled on a cam 68 rigid on the camshaft 28. In the present design of camshaft, each circular cam has its center disposed in radially offset relation to the true center line of the camshaft; i.e., the axis of rotation of the shaft. The angular offset of the center of each successive cam relative to its preceding neighbor according to a preferred embodiment as follows: Looking now at FIG. 2 and considering the first two cams 68 at the lefthand side of the Figure and considering these two cams as a first set of cams, the two cams are angularly offset relative to each other by one-hundred and eighty degrees. As to the next two cams to the right of the first set, which may be considered as a second set, the first cam of this second set is angularly offset by thirty-six degrees from the first cam of the first set and the second cam of the second set is phased one-hundred and eighty degrees from the first cam of the second set. Since the drawing in FIG. 2 has been fore-shortened to conserve space 4, not all cam sets are shown, but from the pattern just noted, it will be set that the first cam of each succeeding set is angularly offset from the first cam in the preceding set and the second cam in each set is offset one-hundred and eighty degrees from the first cam in that set. Again noting a preferred embodiment, there may be ten sets of cams (a total of twenty) in the A system, made up of two consecutive groups of five sets each. For example, assuming a starting point of zero, the cams in the first set are related in degrees by 0 and 180; the relationship in the second set is 36 and 216; in the third set 72 and 252; in the fourth start at 108 and 288, etc. In other words, the radial offset of the center of each cam relative to the true center line of the basic shaft provides in effect a crank arm The use of the circular, eccentric cams enables positive drive between the cams and the beaters without resort to the use of springs, lifters, etc.

Figure 2:
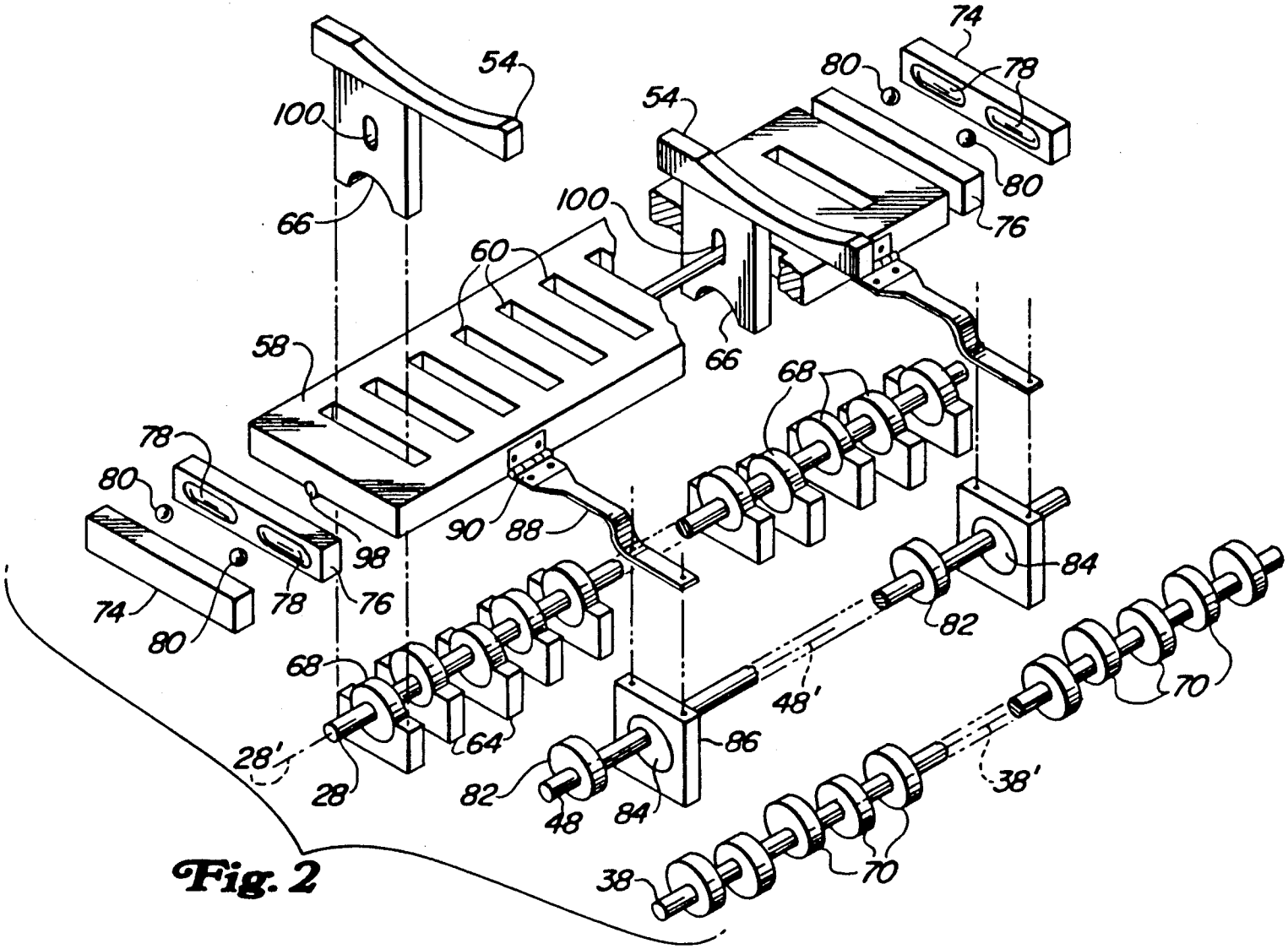
FIG. 2 is an "exploded" perspective of portions of the basic system.

A similar situation exists in system B, where the lower ends of the beaters 56 ride on eccentric cams 70 on the camshaft 38 except that the timing of may differ from that of the cams 68, for purposes to presently appear. One way to achieve this is to angularly offset the arrangement of cams 70 relative to the cams. Another way is to have the gears 26 and 36 of slightly different diameters. Other ways will occur to those versed in the art. By way of further clarification of the cam design, the basic center lines of the shafts 28, 38 and 48 are indicated in FIG. 2 by the numerals 28', 38' and 48' respectively. System B is further augmented by a slotted guide board 72 like the board 58.

From the description thus far, it is seen that rotation of the camshafts 28 and 38 effect compound reciprocation and oscillation of the respective beaters through the respective slots in the guide boards (FIG. 5). In system A, the guide means board 58 is mounted in the frame for lateral reciprocation by means of end bearings comprising complementary elements 74 and 76, the former being affixed to the frame (one at each end) and the latter being affixed to the proximate end of the board 58. These members are similar to each other and have elongated slots 78 in which ball bearings 80 provide the anti-friction connection (FIGS. 2 and 6). The other guide board 72 is similarly mounted by like bearing means, not shown but obvious from what has been said about the bearings for the board 58.

As best seen in FIGS. 2 and 3, the center camshaft 48 has a plurality of cams rigid thereon. In the present case, there are two cams 82 and 84 adjacent opposite ends of the camshaft. The eccentricity of the cam 82 is one-hundred and eighty degrees offset from that of the cam 84 and these cams function to impart opposite lateral reciprocation to the guide boards 58 and 72. Each cam 84 journals thereon a block 86 to which is affixed a relatively stiff strap 88 that is in turn hinged at 90 to the board 58. A similar block 92 is journalled on each of the other cams 82 and is connected by a strap 94 and hinge 96 to the other guide board 72. Thus, as the camshaft 48 rotates, the boards 58 and 72 are reciprocated oppositely.

It is seen from FIG. 2 that the lateral width of the depending portion of each beater is less than the lateral length of the slots in the guide boards, which enables movement of the beaters relative to the boards and beaters that is instrumental in controlling the movement of the beaters to give the desired roving movement of the beater sets in the systems A and B (FIG. 4). Lost-motion means in system A comprises a rod and slot interconnection between the beaters 54 and the board 58, in which a longitudinal pivot element in the form of a rod 98 is fixed to and runs lengthwise of the underside of the board 58 and which further extends loosely through beater slots 100. If desired, the ends of the rod 98 could be carried by the end bearings 76 and the guide board replaced by members spaced apart to provide slots equivalent to the slots 60. A similar arrangement exists in system B in the form of a rod 102 and beater slots 104.

FIG. 4 illustrates a sequence of a series of beaters 54 and shows how their respective cams cause the beaters to assume different positions during movement. FIG. 5 shows several positions of a beater during rotation of its cam in a status assuming the rod 98 to be fixed, in which case the beaters will move vertically and also rock laterally about the pivot axis of the rod. Consider then the timed lateral reciprocation of the associate guide board which of course shifts the pivot rods back and forth which thus adds further movement to the beaters beyond the positions represented in FIG. 5. In a preferred form of the invention, the camshafts 28 and 38 rotate according to the timing described earlier herein and the center camshaft turns at a lower speed. Because of the variable-speed drive (FIG. 1) these speeds can be infinitely varied within limits. Drive means other than that depicted may be resorted to.

Variations in other aspects of the preferred embodiment will occur to those versed in the art, all without departure from the spirit and scope of the invention.

We claim:

1. A power-driven massager, comprising a longitudinal frame, an elongated, horizontal guide means extending lengthwise of the frame and providing a plurality of lengthwise spaced apart vertically opening through slots, a plurality of beaters extending respectively through and guided by the slots and having upper and lower ends respectively above and below the guide means, a first longitudinal beater camshaft journalled on the frame below the lower ends of the beaters and including a plurality of axially spaced apart cams respectively engaging the lower ends of the beaters for moving the beaters, and lost-motion means interconnecting the beaters and the frame for enabling vertical reciprocation and lateral rocking of the beaters as the camshaft rotates.

2. The massager according to claim 1, in which the lost-motion means includes vertical slots in the beaters and a longitudinal pivot element carried by the frame and passing through the slots in the beaters.

3. The massager according to claim 1, including means carried by the frame and engaging the pivot element for moving the pivot element laterally.

4. The massager according to claim 3, in which said means is operable to reciprocate the pivot element laterally.

5. The massager according to claim 4, in which said means includes a second beater camshaft parallel to the first beater camshaft.

6. The massager according to claim 5, including drive means for rotating the first beater camshaft at a speed greater than that of the second beater camshaft.

7. The massager according to claim 1, in which the beaters, guide means and lost-motion means comprise a first system and a second system containing beaters, guide means and lost-motion means is arranged in side-by-side symmetrical relation to the first system.

8. The massager according to claim 7, including means centrally between the systems for moving the beaters laterally in addition to movement derived from the camshaft.

9. The massager according to claim 8, in which the means for moving the beaters laterally is operative to reciprocate the beaters oppositely laterally.

10. The massager according to claim 9, in which the means for reciprocating the beaters laterally includes a third camshaft centrally between the camshaft of the first and second systems.

11. The massager according to claim 1, in which the cams are arranged in such fashion that the beaters move differently from their neighbors.

12. The massager according to claim 1, in which the guide means includes an elongated horizontal member carried by the frame and having the slots therein.

13. The massager according to claim 1, in which successive cams are angularly offset relative to their neighbors so as to give beaters different movements.

14. A power-drive massager, comprising a longitudinal frame, a first longitudinal camshaft journalled on the frame for rotation on a horizontal axis and having a plurality of axially spaced apart cams angularly timed differently from each other, a plurality of upstanding beaters equal in number to and respectively engaging and driven by the cams as the camshaft rotates, each beater having an upright slot therein, a longitudinal rod having means mounting same on the frame and passing loosely through the slots to enable combined lateral rocking and vertical movement of the beaters as the camshaft rotates.

15. The massager according to claim 14, including guide means interposed respectively between neighboring beaters for spacing the beaters apart lengthwise of the frame.

16. The massager according to claim 14, in which the means mounting the rod on the frame is constructed to enable the rod to be moved bodily laterally of the frame.

17. The massager according to claim 16, including means for moving the rod laterally.

18. The massager according to claim 17, in which the rod-moving means is operative to reciprocate the rod laterally.

19. The massager according to claim 18, in which the camshaft, beaters, and rod comprise a first system and a like system is repeated in side-by-side relation to the first system at opposite sides of the longitudinal centerline of the frame, and the means for reciprocating the rod in the first system is also operative to reciprocate the rod in the recent system.

20. The massager according to claim 19, in which the rod reciprocating means is operative to reciprocate the rods oppositely so that both rods move laterally toward each other and then laterally away from each other on consecutive strokes of reciprocation.

* * * * *